US010283864B2

(12) United States Patent
Li et al.

(10) Patent No.: US 10,283,864 B2
(45) Date of Patent: May 7, 2019

(54) ANTENNA AND TERMINAL

(71) Applicant: Huawei Device Co., Ltd., Dongguan (CN)

(72) Inventors: Jianming Li, Taipei (TW); Hanyang Wang, Shenzhen (CN); Kun Feng, Shanghai (CN); Xiaoju Zhang, Shanghai (CN)

(73) Assignee: HUAWEI DEVICE (DONGGUAN) CO., LTD., Dongguan (CN)

( * ) Notice: Subject to any disclaimer, the term of this patent is extended or adjusted under 35 U.S.C. 154(b) by 0 days.

(21) Appl. No.: 15/186,123

(22) Filed: Jun. 17, 2016

(65) Prior Publication Data

US 2016/0301134 A1 Oct. 13, 2016

Related U.S. Application Data

(63) Continuation of application No. PCT/CN2013/090144, filed on Dec. 20, 2013.

(51) Int. Cl.

| | |
|---|---|
| ***H01Q 5/328*** | (2015.01) |
| ***H01Q 1/48*** | (2006.01) |
| ***H01Q 9/04*** | (2006.01) |
| ***H01Q 5/335*** | (2015.01) |

(52) U.S. Cl.

CPC ..... *H01Q 5/328* (2015.01); *H01Q 1/48* (2013.01); *H01Q 5/335* (2015.01); *H01Q 9/0421* (2013.01)

(58) Field of Classification Search

CPC ..... H01Q 5/328; H01Q 5/335; H01Q 1/48; H01Q 9/0421

See application file for complete search history.

(56) References Cited

U.S. PATENT DOCUMENTS

| | | | |
|---|---|---|---|
| 8,570,227 | B1 | 10/2013 | Mileski |
| 8,629,813 | B2 | 1/2014 | Milosavljevic |
| 2004/0075614 | A1 | 4/2004 | Dakeya et al. |
| 2006/0017621 | A1 | 1/2006 | Okawara et al. |
| 2007/0285335 | A1 | 12/2007 | Bungo et al. |
| 2009/0278755 | A1 | 11/2009 | Shoji |

(Continued)

FOREIGN PATENT DOCUMENTS

| | | | |
|---|---|---|---|
| CN | 201060933 | Y | 5/2008 |
| CN | 101212230 | A | 7/2008 |

(Continued)

OTHER PUBLICATIONS

Wong, Kin-Liu et al., 4G/Multiband Handheld Device Ground Antennas, Asia-Pacific Microwave Conference Proceedings, 2013, 3 pages.

(Continued)

*Primary Examiner* — Hai V Tran
*Assistant Examiner* — Michael M Bouizza
(74) *Attorney, Agent, or Firm* — Slater Matsil, LLP

(57) ABSTRACT

The present invention discloses an antenna and a terminal, which can extend antenna bandwidth. The antenna includes a capacitor component and at least one radiator, where one end of each radiator of the at least one radiator is connected to form a first node, the first node is connected to one end of the capacitor component to form a second node, and the second node is grounded; and the other end of the capacitor component receives a feed signal.

20 Claims, 4 Drawing Sheets

(56) References Cited

U.S. PATENT DOCUMENTS

| | | | | |
|---|---|---|---|---|
| 2010/0302123 | A1* | 12/2010 | Knudsen | H01Q 5/35 343/861 |
| 2011/0102290 | A1* | 5/2011 | Milosavljevic | H01Q 1/243 343/852 |
| 2012/0146865 | A1 | 6/2012 | Hayashi et al. | |
| 2012/0231750 | A1 | 9/2012 | Jin et al. | |
| 2012/0299781 | A1 | 11/2012 | Lee | |
| 2012/0306709 | A1 | 12/2012 | Wu et al. | |
| 2013/0027260 | A1 | 1/2013 | Jeon et al. | |
| 2013/0122828 | A1 | 5/2013 | Choi | |
| 2013/0154888 | A1 | 6/2013 | Lin et al. | |
| 2013/0194139 | A1 | 8/2013 | Nickel et al. | |
| 2014/0292602 | A1 | 10/2014 | Suzuki et al. | |

FOREIGN PATENT DOCUMENTS

| | | | |
|---|---|---|---|
| CN | 201374385 | Y | 12/2009 |
| CN | 101809813 | A | 8/2010 |
| CN | 201910796 | U | 7/2011 |
| EP | 2234205 | A1 | 9/2010 |
| EP | 2787574 | A1 | 8/2014 |
| JP | 10-028013 | | 1/1998 |
| JP | 10-107671 | | 4/1998 |
| JP | 2001136019 | A | 5/2001 |
| JP | 2003249811 | A | 9/2003 |
| JP | 2004266311 | A | 9/2004 |
| JP | 2005210680 | A | 8/2005 |
| JP | 2008258670 | A | 10/2008 |
| JP | 2011015034 | A | 1/2011 |
| JP | 2012182726 | A | 9/2012 |
| JP | 2012244608 | A | 12/2012 |
| JP | 2013017112 | A | 1/2013 |
| JP | 2013110624 | A | 6/2013 |
| KR | 20120092663 | A | 8/2012 |
| WO | 2013076894 | A1 | 5/2013 |

OTHER PUBLICATIONS

Wong, Kin-Liu et al., Small-Size Planar LTE/WWAN Antenna and Antenna Array Formed by the Same for Tablet Computer Application. Microwave and Optical Technology Letters/ vol. 55, No. 8, Aug. 2013, 7 pages.

* cited by examiner

ANTENNA AND TERMINAL

CROSS-REFERENCE TO RELATED APPLICATIONS

This application is a continuation of International Application No. PCT/CN2013/090144, filed on Dec. 20, 2013, which application is hereby incorporated herein by reference.

TECHNICAL FIELD

The present invention relates to the field of communications technologies, and in particular, to an antenna and a terminal.

BACKGROUND

A terminal in a mobile communications network transmits and receives signals by using an antenna. With development and application of technologies, antenna bandwidth of a terminal product needs to cover more bands. In addition, in order to seek an esthetic appearance, space reserved for the antenna is increasingly smaller. Obviously, a traditional passive antenna can hardly meet requirements in an application scenario, and people pay more attention to a tunable antenna that combines a passive antenna and a tunable device.

A tunable antenna based on an IFA (Inverted-F Antenna) architecture in the prior art is shown in FIG. 1. The IFA is a classic passive antenna. A single-pole and double-throw switch is serially connected to a ground point of the IFA, and an inductor or an invariable capacitor is serially connected by using the single-pole double-throw switch to implement grounding. That the IFA is grounded by using the inductor or the invariable capacitor necessarily changes an impedance property of the tunable antenna shown in FIG. 1, thereby implementing a change of an operating band. A sum of bands that can be covered in all states of the antenna is antenna bandwidth.

However, a low-frequency resonance frequency of the tunable antenna depends on a length of a long branch of an intermediate- or low-frequency radiator of radiators. A length of the radiator affects an overall size of the antenna. That is, in a case in which the size of the antenna is limited to some extent, the antenna bandwidth may be relatively narrow and cannot meet application requirements.

SUMMARY

Embodiments of the present invention provide an antenna and a terminal, so as to extend antenna bandwidth.

According to a first aspect, an antenna is provided, including a capacitor component and at least one radiator, where one end of each radiator of the at least one radiator is connected to form a first node, the first node is connected to one end of the capacitor component to form a second node, and the second node is grounded. The other end of the capacitor component receives a feed signal.

With reference to the first aspect, in a first possible implementation manner, the antenna further includes at least one matching circuit, one end of each matching circuit of the at least one matching circuit is connected to form a third node, the third node is connected to the other end of the capacitor component, and the other end of the capacitor component receives the feed signal by using each matching circuit of the at least one matching circuit, where the matching circuit includes an inductor and/or a capacitor.

With reference to the first aspect or the first possible implementation manner of the first aspect, in a second possible implementation manner, the antenna further includes at least one tunable circuit, one end of each tunable circuit of the at least one tunable circuit is connected to form a fourth node, the fourth node is connected to the second node, and the second node is grounded by using each tunable circuit of the at least one tunable circuit, where the tunable circuit is capacitive or inductive.

With reference to the second possible implementation manner of the first aspect, in a third possible implementation manner, the tunable circuit is specifically a matching circuit or a filter.

With reference to the second possible implementation manner of the first aspect, in a fourth possible implementation manner, the tunable circuit is specifically a single-pole double-throw switch, where a movable end of the single-pole double-throw switch serves as the one end of the tunable circuit that forms the fourth node, one immovable end of the single-pole double-throw switch serves as a grounding end of the tunable circuit, and the other immovable end of the single-pole double-throw switch is free.

With reference to the second possible implementation manner of the first aspect, in a fifth possible implementation manner, the tunable circuit specifically includes a first matching circuit, a second matching circuit, and a single-pole double-throw switch, where a movable end of the single-pole double-throw switch serves as the one end of the tunable circuit that forms the fourth node. Two immovable ends of the single-pole double-throw switch are connected to one end of the first matching circuit and one end of the second matching circuit respectively. The other end of the first matching circuit is connected to another end of the second matching circuit to form a fifth node, and the fifth node serves as a grounding end of the tunable circuit.

With reference to the second possible implementation manner of the first aspect, in a sixth possible implementation manner, the tunable circuit specifically includes an input capacitor, a low-frequency capacitor, a high-frequency capacitor, and a single-pole double-throw switch, where one end of the input capacitor is connected to a movable end of the single-pole double-throw switch, and the other end of the input capacitor serves as the one end of the tunable circuit that forms the fourth node. One end of the low-frequency capacitor and one end of the high-frequency capacitor are connected to two immovable ends of the single-pole double-throw switch respectively. The other end of the low-frequency capacitor is connected to the other end of the high-frequency capacitor to form a sixth node, and the sixth node serves as a grounding end of the tunable circuit.

With reference to the first aspect, or the second possible implementation manner of the first aspect, or the third possible implementation manner of the first aspect, or the fourth possible implementation manner of the first aspect, or the fifth possible implementation manner of the first aspect, or the sixth possible implementation manner of the first aspect, in a seventh possible implementation manner, the capacitor component specifically includes an interdigital capacitor and/or a variable capacitor.

According to a second aspect, a terminal is provided, including any one of the foregoing described antennas.

According to the antenna provided in the first aspect or the terminal provided in the second aspect, a capacitor component is added at a signal feed end of the antenna, and the capacitor component and a distributed inductor of a ground cable can generate low-frequency resonance. A frequency of the low-frequency resonance can be tuned by changing the capacitor component or the distributed inductor, without a need to change a length of a radiator. Therefore, in a case in which an antenna size is limited to some extent, the solution provided in the embodiments of the present invention can extend the antenna bandwidth.

BRIEF DESCRIPTION OF THE DRAWINGS

The accompanying drawings are intended for further understanding of the present invention, and constitute a part of this specification. They are used together with the embodiments of the present invention to interpret the present invention but do not constitute any limitation on the present invention. In the accompanying drawings.

DETAILED DESCRIPTION OF ILLUSTRATIVE EMBODIMENTS

To give a solution to extending antenna bandwidth, embodiments of the present invention provide an antenna and a terminal. The following describes exemplary embodiments of the present invention with reference to the accompanying drawings of this specification. It should be understood that the exemplary embodiments described herein are merely used to describe and explain the present invention, but are not intended to limit the present invention. The embodiments in this application and features in the embodiments may be combined with each other under circumstances of no conflicts.

Figure 1:
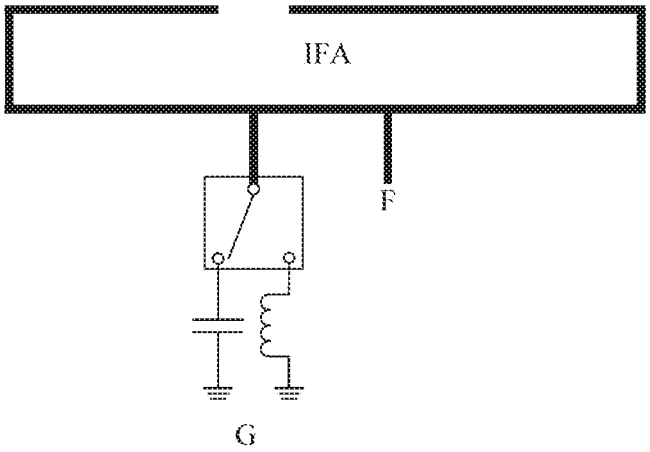
FIG. 1 is a schematic diagram of an antenna in the prior art.
Figure 2:
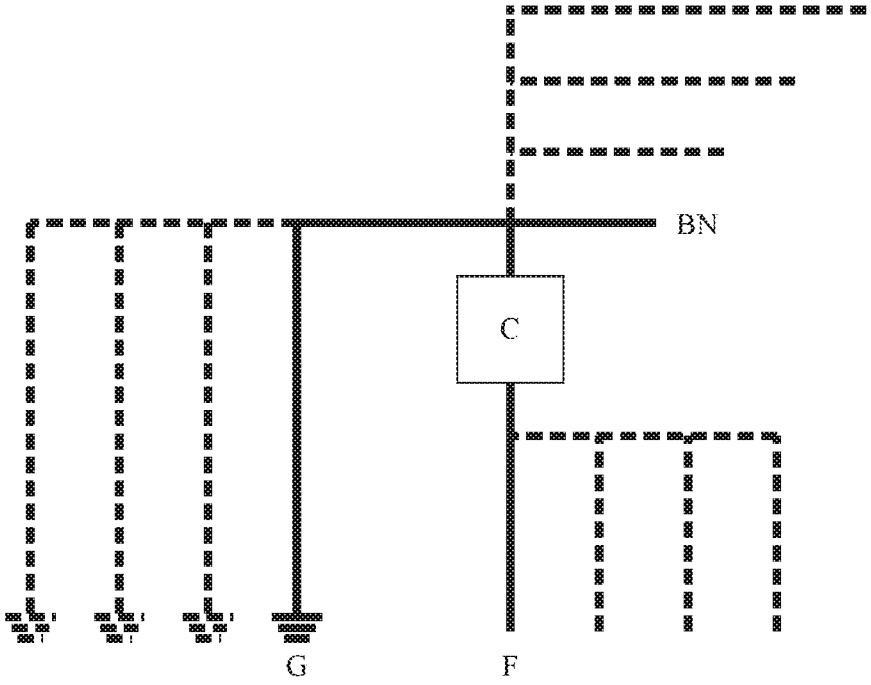
FIG. 2 is a first schematic diagram of an antenna according to an embodiment of the present invention.

An embodiment of the present invention provides an antenna, which, as shown in FIG. 2, includes a capacitor component C and at least one radiator BN, where one end of each radiator BN of the at least one radiator is connected to form a first node, the first node is connected to one end of the capacitor component C to form a second node, and the second node is grounded. The other end of the capacitor component C receives a feed signal.

That is, a node formed after the one end of each radiator BN is connected and then is connected to the one end of the capacitor component C serves as the second node, where the second node serves as a grounding end G of the antenna; and the other end of the capacitor component C serves as a signal feed end F of the antenna.

The capacitor component C is added at the signal feed end F of the antenna. The capacitor component C and a distributed inductor of a ground cable can generate low-frequency resonance. A frequency of the low-frequency resonance can be tuned by changing the capacitor component C or the distributed inductor.

Figure 3:
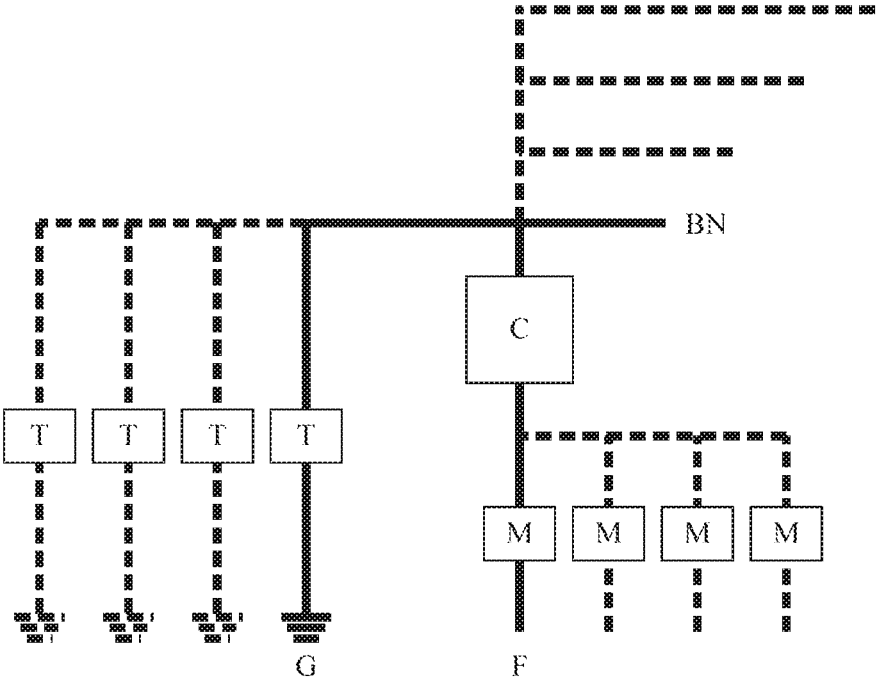
FIG. 3 is a second schematic diagram of an antenna according to an embodiment of the present invention.

Preferably, as shown in FIG. 3, the antenna further includes at least one matching circuit M, one end of each matching circuit M of the at least one matching circuit is connected to form a third node, the third node is connected to the other end of the capacitor component C, and the other end of the capacitor component C receives the feed signal by using each matching circuit M of the at least one matching circuit, where the matching circuit M includes an inductor and/or a capacitor.

That is, two types of devices: an inductor and a capacitor, may exist in the matching circuit M, and a specific quantity of the inductors or capacitors and a manner of connecting them are not limited. Serial connection, parallel connection or hybrid connection of any quantity of inductors and capacitors may serve as a specific implementation manner of the matching circuit M in the antenna provided in this embodiment of the present invention.

With the matching circuit M added, antenna bandwidth can be extended by serially connecting an inductor or capacitor at the signal feed end F.

Preferably, as shown in FIG. 3, the antenna further includes at least one tunable circuit T, one end of each tunable circuit T of the at least one tunable circuit is connected to form a fourth node, the fourth node is connected to the second node, and the second node is grounded by using each tunable circuit T of the at least one tunable circuit, where the tunable circuit T is capacitive or inductive.

By using the tunable circuit T, the frequency of low-frequency resonance can be tuned, an impedance property of the antenna can be changed, and more tunable states of the antenna can be added.

Figure 4:
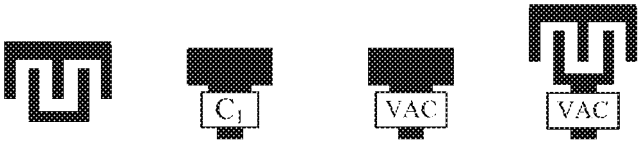
FIG. 4 is a schematic diagram of a capacitor component in an antenna according to an embodiment of the present invention.

Further, the capacitor component C may be specifically implemented in multiple manners, and FIG. 4 enumerates four manners.

In a first implementation manner of the capacitor component C, the capacitor component C is specifically an interdigital capacitor whose bandwidth is relatively wide but invariable.

In a second implementation manner of the capacitor component C, the capacitor component C is specifically an invariable capacitor $C_1$ whose bandwidth is relatively narrow and invariable.

In a third implementation manner of the capacitor component C, the capacitor component C is specifically a variable capacitor VAC whose bandwidth is relatively narrow but variable.

Preferably, in a fourth implementation manner of the capacitor component C, the capacitor component C specifically includes an interdigital capacitor and a variable capacitor VAC whose bandwidth is relatively wide and variable.

The foregoing four specific implementation manners are merely exemplary, and are not intended to limit the present invention. Any other capacitor-type device or a combination of capacitor-type devices may serve as a specific implementation manner of the capacitor component C in the antenna provided in this embodiment of the present invention.

Figure 5:
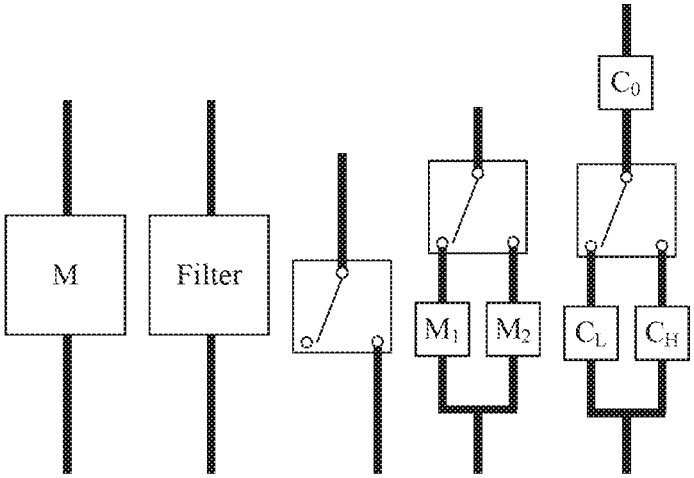
FIG. 5 is a schematic diagram of a tunable circuit in an antenna according to an embodiment of the present invention.

Further, the tunable circuit T may be specifically implemented in multiple manners, and FIG. 5 enumerates five manners.

In a first implementation manner of the tunable circuit T, the tunable circuit T is specifically a matching circuit M, and preferably, the matching circuit M includes a variable capacitor. When the matching circuit M includes a variable capacitor, the tunable states are not limited. The more the tunable states, the wider the antenna bandwidth.

In a second implementation manner of the tunable circuit T, the tunable circuit T is specifically a filter Filter. In this case, the tunable states are limited.

In a third implementation manner of the tunable circuit T, the tunable circuit T is specifically a single-pole double-throw switch, where a movable end of the single-pole double-throw switch serves as the one end of the tunable circuit that forms the fourth node, one immovable end of the single-pole double-throw switch serves as a grounding end of the tunable circuit, and the other immovable end of the single-pole double-throw switch is free. In this case, a switching loss exists, and the tunable states are limited.

In a fourth implementation manner of the tunable circuit T, the tunable circuit T specifically includes a first matching circuit $M_1$, a second matching circuit $M_2$, and a single-pole double-throw switch, where a movable end of the single-pole double-throw switch serves as the one end of the tunable circuit that forms the fourth node; two immovable ends of the single-pole double-throw switch are connected to one end of the first matching circuit and one end of the second matching circuit respectively; and the other end of the first matching circuit is connected to another end of the second matching circuit to form a fifth node, and the fifth node serves as a grounding end of the tunable circuit. In this case, a switching loss exists, and the tunable states depend on specific implementation of the two matching circuits.

In a fifth implementation manner of the tunable circuit T, the tunable circuit T specifically includes an input capacitor $C_o$, a low-frequency capacitor $C_L$, a high-frequency capacitor $C_H$, and a single-pole double-throw switch, where one end of the input capacitor is connected to a movable end of the single-pole double-throw switch, and the other end of the input capacitor serves as the one end of the tunable circuit that forms the fourth node; and one end of the low-frequency capacitor and one end of the high-frequency capacitor are connected to two immovable ends of the single-pole double-throw switch respectively, the other end of the low-frequency capacitor is connected to the other end of the high-frequency capacitor to form a sixth node, and the sixth node serves as a grounding end of the tunable circuit. In this case, a switching loss exists, and the tunable states are limited.

The foregoing five specific implementation manners are merely exemplary, and are not intended to limit the present invention. Any other capacitive or inductive device or circuit may serve as a specific implementation manner of the tunable circuit T in the antenna provided in this embodiment of the present invention.

The following elaborates on the antenna provided in the present invention with reference to the accompanying drawings by using specific embodiments.

Embodiment 1

An antenna provided in Embodiment 1 of the present invention is applicable to GSM 900/1800/1900 and WCDMA 2100.

Figure 6:
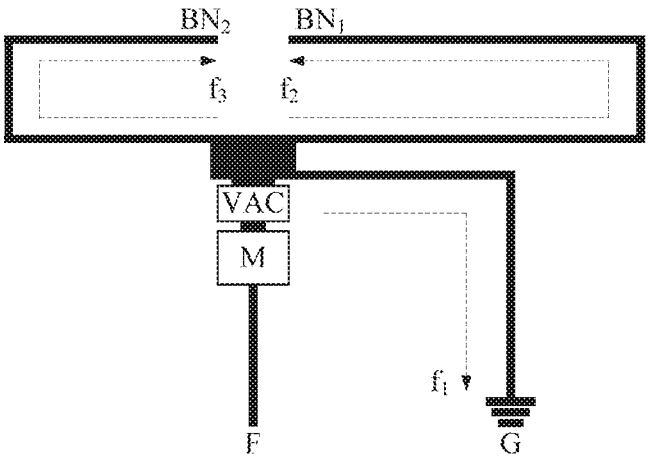
FIG. 6 is a schematic diagram of an antenna according to Embodiment 1 of the present invention.

FIG. 6 shows the antenna provided in Embodiment 1 of the present invention, which includes a capacitor component, two radiators $BN_1$ and $BN_2$ and a matching circuit M, where the capacitor component is specifically a variable capacitor VAC. One end of the radiator $BN_1$, one end of the radiator $BN_2$, and one end of the variable capacitor VAC are connected, and a node formed after the three ends are connected serves as a grounding end G of the antenna. The other end of the variable capacitor VAC is connected to one end of the matching circuit M, and another end of the matching circuit M serves as a signal feed end F of the antenna.

In the antenna provided in Embodiment 1 of the present invention, the variable capacitor VAC and a distributed inductor of a ground cable generate a low-frequency resonance frequency $f_1$.

The low-frequency resonance frequency $f_1$ can be tuned by changing the distributed inductor, that is, changing a length of the ground cable. Experiments prove that the length of the ground cable is generally less than one eighth of a waveguide wavelength, and the waveguide wavelength is a signal wavelength of a center frequency of antenna applied bandwidth. In a given inductance value range, the greater the distributed inductance, the higher the low-frequency resonance frequency $f_1$.

The low-frequency resonance frequency $f_1$ is also fine-tunable by changing an capacitance value of the variable capacitor VAC. In a given capacitance value range, the greater the capacitance value of the variable capacitor VAC, the lower the low-frequency resonance frequency $f_1$.

By using the radiator $BN_1$, a high-frequency resonance frequency $f_2$ can be generated; and by using the radiator $BN_2$, a high-frequency resonance frequency $f_3$ can be generated.

When the low-frequency resonance frequency $f_1$ is tuned by changing the capacitance value of the capacitor component, that is, the variable capacitor VAC, the high-frequency resonance frequencies $f_2$ and $f_3$ are slightly affected.

That is, bandwidth of the antenna provided in Embodiment 1 of the present invention is a band covered by the resonance frequencies $f_1$, $f_2$, and $f_3$.

Embodiment 2

An antenna provided in Embodiment 2 of the present invention is applicable to GSM/DCS/PCS/WCDMA/LTE.

Figure 7:
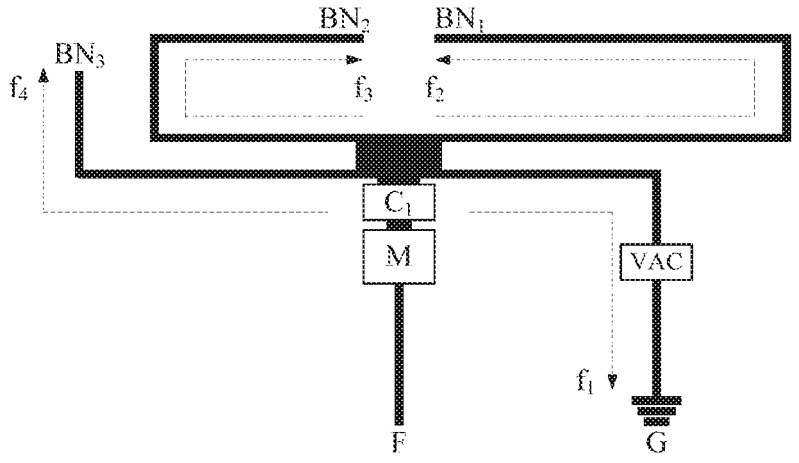
FIG. 7 is a schematic diagram of an antenna according to Embodiment 2 of the present invention.

FIG. 7 shows the antenna provided in Embodiment 2 of the present invention, which includes a capacitor component, three radiators $BN_1$, $BN_2$, and $BN_3$, a matching circuit M, and a tunable circuit, where the capacitor component is specifically an invariable capacitor $C_1$, and the tunable circuit is specifically a variable capacitor VAC. Five ends, that is, one end of the radiator $BN_1$, one end of the radiator $BN_2$, one end of the radiator $BN_3$, one end of the variable capacitor VAC, and one end of the invariable capacitor $C_1$, are connected. The other end of the invariable capacitor $C_1$ is connected to one end of the matching circuit M, and the other end of the matching circuit M serves as a signal feed end F of the antenna. The other end of the variable capacitor VAC serves as a grounding end G of the antenna.

In the antenna provided in Embodiment 2 of the present invention, the invariable capacitor $C_1$ and an inductor of a ground cable generate a low-frequency resonance frequency $f_1$.

An inductance value of the ground cable can be changed by changing a capacitance value of the variable capacitor VAC, and further, the low-frequency resonance frequency $f_1$ can be tuned. In a given capacitance value range, the greater the capacitance value of the variable capacitor VAC, the higher the low-frequency resonance frequency $f_1$.

By using the radiator $BN_1$, a high-frequency resonance frequency $f_2$ can be generated; by using the radiator $BN_2$, a high-frequency resonance frequency $f_3$ can be generated; and by using the radiator $BN_3$, a high-frequency resonance frequency $f_4$ can be generated.

When the low-frequency resonance frequency $f_1$ is tuned by changing the tunable circuit, that is, by changing the capacitance value of the variable capacitor VAC, the high-frequency resonance frequencies $f_2$, $f_3$, and $f_4$ are not affected.

That is, bandwidth of the antenna provided in Embodiment 2 of the present invention is a band covered by the resonance frequencies $f_1$, $f_2$, $f_3$, and $f_4$.

It can be seen that, in a case in which an antenna size is limited to some extent, the solution provided in this embodiment of the present invention can extend the bandwidth and meet requirements of more application scenarios.

Embodiment 3

Embodiment 3 of the present invention further provides a terminal, including an antenna shown in any of FIG. 2, FIG. 3, FIG. 6, and FIG. 7.

Persons skilled in the art should understand that, although some exemplary embodiments of the present invention have been described, the persons skilled in the art can make changes and modifications to these embodiments once they learn the basic inventive concept. Therefore, the following claims are intended to be construed as to cover the exemplary embodiments and all changes and modifications falling within the scope of the present invention.

Obviously, persons skilled in the art can make various modifications and variations to the embodiments of the present invention without departing from the spirit and scope of the embodiments of the present invention. The present invention is intended to cover these modifications and variations provided that they fall within the scope of protection defined by the following claims and their equivalent technologies.

What is claimed is:

1. An antenna comprising a capacitor component, a plurality of radiators, a ground cable, and a first matching circuit, wherein:

the plurality of radiators comprises a first radiator and a second radiator;

one end of the first radiator is connected at a first node to one end of the second radiator, one end of the capacitor component is connected at a second node, the first node is connected to the second node, and the second node is grounded with the ground cable;

the grounded cable comprises a ground end of the antenna, and the grounded cable comprises a distributed inductor;

the other end of the capacitor component receives a feed signal, and is connected to one end of the first matching circuit at a third node, and the other end of the capacitor component receives the feed signal by using the first matching circuit;

the first matching circuit and the capacitor component comprise a signal feed end of the antenna, and the first matching circuit comprises an inductor or a capacitor;

the second node is where the ground end, the signal feed end, and the plurality of radiators are connected to one another; and the signal feed end and the ground end operably generates a low-frequency resonance frequency with the capacitor component and the distributed inductor of the ground cable, and the plurality of radiators operably generate a plurality of high-frequency resonance frequencies that are higher than the low-frequency resonance frequency.

2. The antenna according to claim 1, wherein the antenna further comprises a tunable circuit in the ground end of the antenna, one end of the tunable circuit is connected at a fourth node, the fourth node is connected to the second node, and the second node is grounded by using the tunable circuit; and wherein the tunable circuit is capacitive or inductive.

3. The antenna according to claim 2, wherein the tunable circuit is second matching circuit or a filter.

4. The antenna according to claim 2, wherein the tunable circuit is a single-pole double-throw switch, wherein a movable end of the single-pole double-throw switch serves as the one end of the tunable circuit at the fourth node, one immovable end of the single-pole double-throw switch serves as a grounding end of the tunable circuit, and another immovable end of the single-pole double-throw switch is free.

5. The antenna according to claim 2, wherein the tunable circuit comprises a third matching circuit, a fourth matching circuit, and a single-pole double-throw switch, wherein:

a movable end of the single-pole double-throw switch serves as the one end of the tunable circuit at the fourth node;

one end of the third matching circuit is connected to a first immovable end of the single-pole double-throw switch, and one end of the fourth matching circuit is connected to a second immovable end of the single-pole double-throw switch; and the other end of the third matching circuit is connected to the other end of the a fourth matching circuit at a fifth node, and the fifth node serves as a grounding end of the tunable circuit.

6. The antenna according to claim 2, wherein the tunable circuit comprises an input capacitor, a low-frequency capacitor, a high-frequency capacitor, and a single-pole double-throw switch, wherein:

one end of the input capacitor is connected to a movable end of the single-pole double-throw switch, and the other end of the input capacitor serves as the one end of the tunable circuit at the fourth node; and one end of the low-frequency capacitor is connected to a first immovable end of the single-pole double-throw switch, one end of the high-frequency capacitor is connected to a second immovable end of the single-pole double-throw switch, the other end of the low-frequency capacitor is connected to the other end of the high-frequency capacitor at a sixth node, and the sixth node serves as a grounding end of the tunable circuit.

7. The antenna according to claim 1, wherein the capacitor component comprises an interdigital capacitor or a variable capacitor.

8. The antenna according to claim 1, wherein the antenna is set in a terminal.

9. The antenna according to claim 1, wherein the capacitor component and the first matching circuit are connected in series with a signal feeder, with the first matching circuit between the capacitor component and the signal feeder, wherein the feed signal is received by the capacitor component from the signal feeder, after the feed signal passes through the first matching circuit.

10. The antenna according to claim 1, further comprising a third radiator, wherein one end of the third radiator is connected to the one end of the first radiator and to one end of the second radiator at the first node;

wherein the plurality of high-frequency resonance frequencies comprises a first high-frequency resonance frequency operably generated by the first radiator, a second high-frequency resonance frequency operably generated by the second radiator, and a third high-frequency resonance frequency operably generated by the third radiator.

11. The antenna according to claim 1, further comprising a fifth matching circuit, wherein one end of the fifth matching circuit is connected to the one end of the first matching circuit at the third node.

12. An antenna, comprising:

a variable capacitor (VAC) with a first VAC terminal and a second VAC terminal;

a plurality of radiators comprising a first radiator with a first radiator terminal, and a second radiator with a second radiator terminal;

a matching circuit with a first matching terminal, wherein the matching circuit comprises an inductor or a capacitor that is different from the VAC, wherein the matching circuit and the VAC comprise a signal feed end of the antenna; and a ground cable that comprises a ground end of the antenna, wherein the ground end is a different end than the signal feed end, and wherein the ground cable comprises a distributed inductor;

wherein the first VAC terminal is connected to the first matching terminal, and the first VAC terminal operably receives a feed signal by using the matching circuit;

wherein the second VAC terminal has a first connection to the first radiator terminal, a second connection to the ground cable that grounds the second VAC terminal, and a third connection to the plurality of radiators, so that the signal feed end, the ground end and the plurality of radiators are connected to one another at the second VAC terminal; and wherein a low-frequency resonance frequency is operably generated with the distributed inductor in the ground end, and the VAC in the signal feed end, and a plurality of high-frequency resonance frequencies that are higher than the low-frequency resonance frequency, are operably generated with the plurality of radiators.

13. The antenna according to claim 12, wherein the first radiator terminal is connected to the second VAC terminal through a first node and a second node;

wherein the first node is connected to the second node;

wherein the second connection of the second VAC terminal to the ground cable is also at the second node, so that the ground end, the signal feed end, and the plurality of radiators are connected to one another at the second node; and wherein the matching circuit is connected to the first VAC terminal at a third node.

14. The antenna according to claim 13, further comprising an additional matching circuit with an additional matching terminal connected to the first matching terminal at the third node.

15. The antenna according to claim 13, further comprising an third radiator with a third radiator terminal connected to the first radiator terminal and to the second radiator terminal at the first node.

16. The antenna according to claim 13, further comprising a tunable circuit with a first tunable terminal and a second tunable terminal;

wherein the tunable circuit is in the ground end;

wherein the first tunable terminal is connected to the second node at a fourth node; and wherein the second node is grounded through a third connection of the second tunable terminal to ground.

17. The antenna according to claim 16, further comprising an additional tunable circuit in the ground end, wherein the additional tunable circuit has an additional tunable terminal connected to the first tunable terminal at the fourth node.

18. The antenna according to claim 16, wherein the tunable circuit comprises an additional matching circuit.

19. The antenna according to claim 12, wherein the matching circuit comprises the inductor.

20. A device, comprising a terminal that operably communicates in a wireless mobile network, wherein the terminal comprises:

an antenna system with a grounding side and a signal feeder side opposite the grounding side, wherein the antenna system comprises:

a plurality of radiators;

a variable capacitor;

a matching circuit that comprises a capacitor different from the variable capacitor;

a ground cable that comprises a distributed inductor; and a signal feeder;

wherein the signal feeder side of the antenna system comprises an in series connection of the variable capacitor, the capacitor in the matching circuit, and the signal feeder, with the capacitor in the matching circuit being connected between the variable capacitor and the signal feeder, and a first terminal on the variable capacitor connecting the variable capacitor to the capacitor in the matching circuit, so that the variable capacitor receives a feeder signal from the signal feeder at the first terminal through the capacitor in the matching circuit;

wherein the grounding side of the antenna system comprises a grounded node that connects the grounded side with the plurality of radiators and with the signal feeder side of the antenna system, by connecting one end of each radiator of the plurality of radiators with a second terminal of the variable capacitor, and the second terminal of the variable capacitor is also connected with the ground cable at the grounded node; and wherein the antenna system operably generates a low-frequency resonance frequency on the signal feeder side by the variable capacitor with the distributed inductor in the ground cable, and operably generates, with the plurality of radiators, a plurality of high-frequency resonance frequencies that are higher than the low-frequency resonance frequency.

* * * * *